United States Patent [19]

Miller

[11] 4,260,976

[45] Apr. 7, 1981

[54] CURRENT LIMITING FUSE WITH AUXILIARY ELEMENT

[75] Inventor: Harold L. Miller, Jefferson Borough, Pa.

[73] Assignee: Westinghouse Electric Corp., Pittsburgh, Pa.

[21] Appl. No.: 11,019

[22] Filed: Feb. 9, 1979

[51] Int. Cl.[3] ..... H01H 85/38

[52] U.S. Cl. ..... 337/162; 337/293

[58] Field of Search ..... 337/158–162, 337/291, 293, 295, 296

[56] References Cited

U.S. PATENT DOCUMENTS

| | | | |
|---|---|---|---|
| 3,243,552 | 3/1966 | Mikulecky . | |
| 3,287,524 | 11/1966 | Huber et al. | 337/159 |
| 3,733,572 | 5/1973 | Mikulecky | 337/293 |
| 3,735,317 | 5/1973 | Jacobs | 337/161 |
| 3,813,627 | 5/1974 | Koch | 337/160 |
| 3,983,526 | 9/1976 | Koch | 337/293 |
| 4,028,655 | 6/1977 | Koch | 337/160 |
| 4,123,738 | 10/1978 | Huber | 337/159 |

*Primary Examiner*—William H. Beha, Jr.
*Attorney, Agent, or Firm*—M. J. Moran

[57] ABSTRACT

A current limiting fuse is disclosed in which a main fuse element is wound at a given pitch around a fuse spider or mandrel. An auxiliary fuse element for assisting in low current high voltage current limiting operation is wound at generally the same pitch but in a disposition of non-electrical contact on the same fuse spider or mandrel. At the ends of the auxiliary elements, sheaths of flexible glass material of known thickness and dielectric characteristics are disposed for being wound around a predetermined notch in the fuse element for greatly enhancing the flashover or arc transfer characteristic between the main fuse element and the auxiliary fuse element during a fusing operation.

4 Claims, 3 Drawing Figures

CURRENT LIMITING FUSE WITH AUXILIARY ELEMENT

BACKGROUND OF THE INVENTION

The subject matter of this invention relates generally to current limiting fuses and more particularly to current limiting fuses of the type having auxiliary arcing means.

Current limiting fuses have been an important part of the protection of high voltage power systems for many years. Generally high voltage current limiting fuses include central mandrels or spiders around which an elongated fuse element is wound to compress the length of the fuse body without actually reducing the length of the fuse element. Generally, the fuse element or ribbon has cut therein notches of reduced cross-section at which arcing occurs during a fusing operation. The multiple arcs formed at the notches each contribute an increment of voltage for current limiting purposes. It has been found that in those fuses which have relatively high cross-sectional area for carrying relatively high values of normal load current, it is difficult to achieve current interruption at a relatively low value of overload current. One way for correcting this is taught in U.S. Pat. No. 3,243,552, issued Mar. 29, 1966 to H. W. Mikulecky entitled "Current Limiting Fuse". In this case, an auxiliary fuse element which generally parallels the main fuse element but which is not normally connected thereto is positioned at the ends thereof in close proximity to the main fuse element. When the main fuse element melts during a relatively low overload condition, melting occurs in the center section of the element. A potential difference thus is created between the ends of the auxiliary fuse elements and the main element thus producing electrical arcs in these later regions. This arcing eventually burns through and severs the main element in these regions. These arcs increase the number of electrical arcs which oppose the overload current that is being interrupted. A problem associated with the aforementioned scheme lies in the fact that the arcing and burning process tends to be difficult to control. Generally, clip-on arcing contacts are utilized at the ends of the auxiliary fuse element and spaced relatively close to the main fuse element. The distance between the arcing contact and the main element is often very critical and tolerances must be very close. The density of the arc quenching sand which may exist between the main fuse element and the arcing contacts can be very determinative of the breakdown voltage required. It can vary under certain conditions. U.S. Pat. No. 3,983,526 issued Sep. 28, 1976 to Koch and entitled "Current Limiting Fuse With Auxiliary Element Arcing Clip Spaced By Nonporous Dielectric Member" attempts to solve the aforementioned problem. With the teachings of the latter-mentioned patent, apparatus is utilized for maintaining the arcing contact in the main element at a specific dimension. However, this leads to difficulty in the assembly process. Furthermore, it can be seen that the time required for the arc from the auxiliary element to burn through the main element varies considerably depending upon whether the main element passes over the arcing clip at a solid area, a perforated area, or somewhere therebetween. On a high voltage fuse utilizing several feet of main fuse element, it is very difficult to wind the element so that the aforementioned variation is accounted for. To overcome this, U.S. Pat. No. 3,983,524 issued Sep. 28, 1976 to Koch entitled "Electrical Current Limiting Fuse Having Fusible Element With Additional Cross-Sectional Necks At An Arcing Clip" teaches the use of extra perforations in the area that passes over the arcing clips or terminals. This reduces the difficulty associated with utilizing the arcing clips but does not necessarily remove it. Furthermore, the utilization of extra areas of reduced cross-section add to the complexity of the manufacturing process. It would be advantageous therefore, if a current limiting fuse which utilizes an auxiliary fuse element to cause multiple arcing on low current faults but which does not suffer from the above-mentioned problems could be found.

SUMMARY OF THE INVENTION

In accordance with the invention, a fuse is taught which utilizes a V-notch type main fuse element. An auxiliary fuse element is utilized which includes wires which are inserted into a predetermined length of flexible glass sleeving at the ends of the wires. The glass enclosed ends of the auxiliary wire are then tightly wound around two notched areas of the main fuse element where burn-through is optimized. Furthermore, since the sleeving is of known thickness and wound tightly against the notch, a dimension with extremely close tolerance is provided. Furthermore, the dielectric strength of the glass sleeving is not random but well predicted. The present invention teaches a fuse with an insulating housing having spaced terminal means or ferrules at the ends thereof which communicate with the internal portion of the housing. A main fuse element means is disposed upon a support within the fuse housing. An auxiliary fuse element means is also disposed within the housing in a general disposition of non-contact with the main fuse element. However, the ends of the auxiliary element are surrounded by a sheath of flexible glass or other suitable dielectric with each sheath being disposed in separate areas of reduced cross-section. The glass disintegrates when the potential difference created between the area of reduced cross-section in the main fuse element and the auxiliary fuse element as separated by the glass is so high as to cause an arc to break through the glass. The arc continues to burn back the associated notched regions of the main fuse element thus quickly inserting dielectric into the main current path.

BRIEF DESCRIPTION OF THE DRAWINGS

For a better understanding of the invention, reference may be had to the preferred embodiment thereof shown in the accompanying drawings, in which.

DESCRIPTION OF THE PREFERRED EMBODIMENTS

Figure 1:
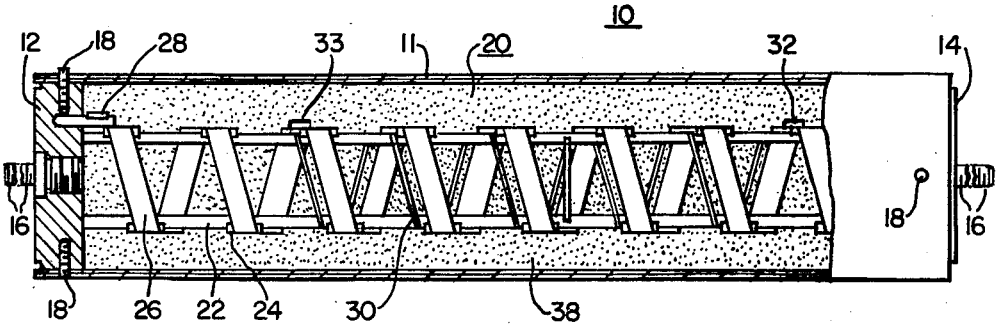
FIG. 1 shows a side elevation partially broken away and partially in section of a current limiting fuse utilizing the teachings of the present invention.

Referring now to the drawings and FIG. 1 in particular, a fuse 10 is shown. In a preferred embodiment of the invention, the fuse 10 may comprise a high voltage current limiting fuse of the type which limits current at relatively low values of overcurrent. The fuse assembly 10 may include a tubular hollow electrically insulating fuse barrel 11 which may be conveniently constructed of glass melamine material. At either end of the fuse barrel 11 and communicating with the internal portion thereof, and ferrules or terminals 12 and 14. The terminals or ferrules 12 and 14 are conveniently mounted in place on the fuse barrel by the utilization of mounting pins or bolts 18. Extending from either end of the fuse barrel 11 may be threaded projections 16 which are utilized for maintaining a disposition of electrical continuity with an electrical circuit which is connected to the fuse assembly 10. Internal to the fuse assembly 10 and surrounded by the fuse barrel 11 is a fuse support assembly 20 which includes spaced rods 22 which traverse the entire length of the fuse and form a fuse mandrel or spider around which an elongated main fuse element 26 is wound. The coil of fuse element material 26 is compressed to fit within the boundaries of the fuse assembly 10 but provides sufficient linear fuse material to support the multiple arcs for high voltage current interruption. To assist in the current limiting process, the fuse rods 22 may comprise non-gas evolving material upon which are disposed localized arc suppressors 24. The fuse element 26 is wound over the suppressors 24 which under the heat of fusing, provide localized regions of arc quenching gas, which effectively quench the arc but generally provide insufficient gas pressure to rupture the tube 11 of the fuse assembly 10. Convenient end stubs 28 are provided in the ferrules or terminals 12 and 14 for example, for electrically communicating between the fuse ribbon 26 and the ferrule 12. Also disposed upon the assembly 20 is an auxiliary fuse element 30. Auxiliary fuse element 30 follows the pitch of the main fuse element 26 but is maintained generally in a disposition of a non-electrical contact therewith. A more detailed description of the interface at the regions 32 and 33 will be described hereinafter in greater detail. Also provided within the fuse barrel 11 may be pulverulent arc quenching material such as silica sand 38, which is utilized for assisting in the arc quenching operation and for absorbing a significant portion of the energy of the fusing operation.

Figure 2:
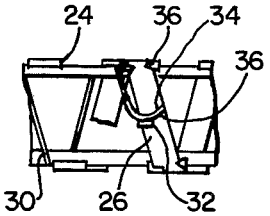
FIG. 2 shows a portion of the fuse assembly of FIG. 1 in a region of high interest.

Referring now to FIG. 2, a portion of the fuse assembly 20 associated with the region 32 (or region 33) is shown. In particular, fuse ribbon 26 is shown as having areas of reduced cross-section 36 therein, at which arcs are formed during the fusing operation for assisting in the current limiting process. Wrapped around the reduced portion of one of the notches 36 is the termination of the parallel auxiliary fuse wire 30. The end portion of the auxiliary fuse wire 30 is enclosed by a flexible glass or other insulating sheath which is securely wound in the notch 36 and crimped thereto. This provides a controlled region where the arcing is forced between the main element 26 and the auxiliary fuse element 30. Arcing occurs in this area because the total dielectric strength is less in this area because of the proximity of the auxiliary element 30 to the fuse element 26. The highly controlled size or thickness of the glass tubing 34 and the homogeneous and well-known dielectric properties thereof cooperate to provide a highly predictable characteristic for the production of an arc in the region 32 between the main fuse ribbon 26 and the auxiliary fuse element 30. The arc occurs because a significant potential difference exists across the thickness of the glass sheath 34 between the auxiliary fuse element 30 and the main fuse element 26 as the main fuse element melts. This has a tendency to destroy the glass tubing 34. Once the arc has begun in the main fuse element 26 it continues rapidly thus inserting more dielectric into the main current path. The time required for the main element to sever is also tightly controlled because the ends of the auxiliary element are always located directly in a notched area of the main element.

Figure 3:
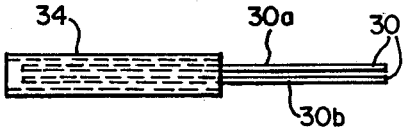
FIG. 3 shows one end of a two auxiliary fuse element assembly with glass sheath.

Referring now to FIG. 3, one end of the two element auxiliary fuse wire 30 is shown. In this case, two auxiliary fuse elements or wires **30*a* and 30*b* are terminated within a sheath 34 as shown in FIG. 3. The two elements may provide multiple arcs or sufficient cathode surface area for establishing an arc between the auxiliary fuse element 30 and the main fuse element 26, such as is shown in FIG. 2**.

It is to be understood with respect to the embodiments of this invention that the particular shape of the mandrel formed by the rods 22 is not limiting nor is the presence of the suppressors 24 limiting. It is also to br understood that although highly desirable, the arc quenching material 38 is not necessary. Furthermore, the particular construction of the ferrules or terminals 12 and 14 is not limiting nor is the particular construction shape or material composition of the fuse barrel 11. It is also to be understood that the auxiliary fuse element is not limited to one or two parallel wires. It is also to be understood that current limitation is not necessary in every operation.

The apparatus taught with respect to the embodiments of this invention has many advantages. One advantage lies in the fact that an auxiliary fuse wire element may be provided for utilization with a main fuse element to provide highly predictable arcing characteristics. Another advantage lies in the fact that the dimensions of the sheath provide predictable dielectric and spacing characteristics between the main fuse element and the auxiliary fuse element in the region of transfer or arc-over during a fusing process. Another advantage lies in the fact that the utilization of the insulating flexible glass material allows for the auxiliary fuse element to gain some support at the ends thereof on the main fuse element independent of the mandrel rods 22 upon which both fuse elements are disposed. Another advantage is that the ends of the auxiliary elements can be directly located in a notched section of the main element thus providing a consistent time period for the arc to burn through the main element.

What I claim as my invention is:

1. A fuse, comprising:

(a) an insulating fuse housing;

(b) spaced terminal means disposed at either end of said housing and communicating with the internal portion thereof;

(c) fuse spider means disposed within said internal portion;

(d) main fuse element means wound around said spider means, said main fuse element means having an area of reduced cross section; and (e) auxiliary fuse element means disposed within said internal portion of said fuse, one portion of said auxiliary fuse element means being disposed in circuit relationship with one of said terminal means, another portion of said auxiliary fuse element means being enclosed in a sheath of flexible material of known dielectric strength, said sheath being disposed in contact with and around said region of reduced cross section, said dielectric strength being sufficient to electrically isolate said main fuse element means from said auxiliary fuse element means during a non-fusing condition, but being insufficient to prevent an electric arc from existing between said main fuse element means and said auxiliary fuse element means during a fusing operation, said sheath being disposed in said area of reduced cross section for being purposely melted by an arc between said main fuse element means and said auxiliary fuse element means after said main fuse element means has begun to blow for thus causing said region of reduced cross section to melt.

2. The combination as claimed in claim 1 wherein said another portion of said auxiliary fuse element comprises an end thereof.

3. The combination as claimed in claim 1 wherein said sheath is of sufficient flexibility to allow it to be wrapped around said area of reduced cross-section.

4. A fuse, comprising:

(a) an insulating fuse barrel;

(b) spaced terminals disposed at either end of said fuse barrel and communicating with the internal portion thereof;

(c) a fuse spider disposed within said fuse barrel;

(d) a main fuse element wound around said fuse spider and connected at each end thereof with one of said terminals, said main fuse element having regions of reduced cross-section; and, (e) an auxiliary fuse element wound around said fuse spider in a general disposition of non-contact with said main fuse element, the ends of said auxiliary fuse element each being surrounded by a sheath of flexible glass, each sheath being disposed in separate areas of reduced cross-section, said glass melting when said main fuse element arcs to said auxiliary fuse element at said areas of reduced cross-section thus burning away portions of said area of reduced cross section.

* * * * *